US005298911A

United States Patent [19]

Li

[11] Patent Number: 5,298,911

[45] Date of Patent: Mar. 29, 1994

[54] SERRATED-ROLL EDGE FOR MICROWAVE ANTENNAS

[76] Inventor: Ming-Chang Li, 11415 Bayard Dr., Mitchellville, Md. 20721

[21] Appl. No.: 767,570

[22] Filed: Sep. 30, 1991

Related U.S. Application Data

[63] Continuation of Ser. No. 584,031, Sep. 18, 1990, abandoned.

[51] Int. Cl.[5] ..... H01Q 15/140; H01Q 19/1

[52] U.S. Cl. ..... 343/912; 343/914

[58] Field of Search ..... 343/914, 912, 915, 916, 343/840, 781 R, 834

[56] References Cited

U.S. PATENT DOCUMENTS

| | | | |
|---|---|---|---|
| 3,599,219 | 8/1971 | Holtum, Jr. et al. | 343/912 |
| 4,307,403 | 12/1981 | Yamada et al. | 343/914 |
| 4,885,593 | 12/1989 | Hess, Jr. et al. | 343/781 R |

FOREIGN PATENT DOCUMENTS

| | | | |
|---|---|---|---|
| 1218629 | 5/1960 | France | 343/914 |
| 54-23449 | 2/1979 | Japan | 343/914 |
| 1190438 | 11/1985 | U.S.S.R. | 343/772 |

OTHER PUBLICATIONS

Burnside et al., Curved Edge Modification of Compact Range Reflector, IEEE Trans. Ant. & Prop., AP35, No. 2 Feb. 1987, pp. 176–182.

Translation of Japan Kokai Pub. #62-098805 to Momose et al. Published May 8, 1987, 11 pages.

*Primary Examiner*—Rolf Hille

*Assistant Examiner*—Hoanganh Le

[57] ABSTRACT

The invention presents an optimum method and mean for reducing the side robes of microwave antennas whether mounted or through the serrated-roll treatment of their edges. The reduction of side robes leads to the enhancement of the main robe, the suppression of the unwanted electromagnetic interference, the improvement of antenna performance, as well as lowering the size of antenna.

5 Claims, 5 Drawing Sheets

SERRATED-ROLL EDGE FOR MICROWAVE ANTENNAS

Figure 1:
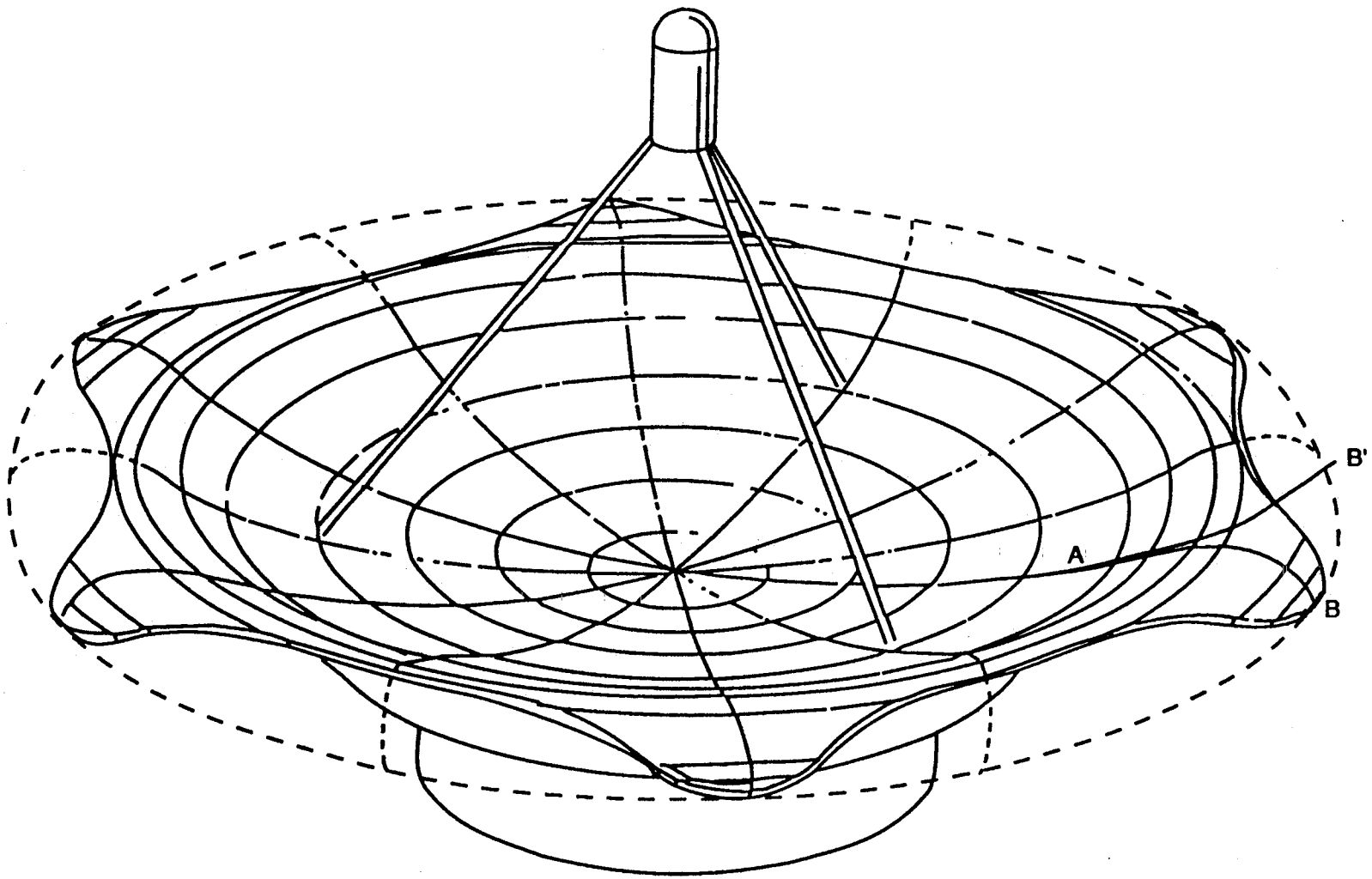

This is a continuation of application appn. Ser. No. 07/584,031 filed Sep. 18, 1990 now abandone.

TECHNICAL FIELD OF INVENTION

This invention is on the edge treatment of microwave antennas to enhance their performance.

BACKGROUND

Microwave antennas are primarily used for transmitting and receiving microwave radiation from free space. The shapes of microwave antennas depend upon their configuration: dish or horn shaped for single feed, and flat or conformed patch for multiple feed phased arrays. The finite size of these antennas creates appreciable side lobes which lead to performance degradation. These side lobes are the result of edge diffraction of the radiation from the feed. The diffraction spreads the radiation into unwanted directions and causes interference with other electronic systems. A proper edge treatment will reduce the strength of these side lobes and enhance antenna performance. Many methods have been suggested. The two most common are serrated edge and rolled back edge. The present invention is an improvement on both.

The edges of widely used microwave antennas have not been properly treated. These antennas have shapes which can be categorized as, horns, dishes, or patches. Two current methods of serrated edge and rolled back edge are closely related to the present invention. Both modify the characteristic of the antenna edges by adding skirts along the rim, yet still maintain the basic structure of the antennas. This form of modification is usually referred to as the edge treatment.

The theoretical foundations and designs for microwave antennas with serrated or rolled back edges are widely publicized and were intensively debated at the *Annual Meetings and Symposiums of the Antenna Measurement and Techniques Association* for at least past ten years. The supporters of both camp have repeatedly argued the advantage and superiority of these two distinctive designs.

There are considerable differences between these two designs. The serrated edge treatment simply extends the surface of a microwave antenna. The surface curvature remains the same, but the extended surface area is gradually reduced to zero during the extension. The controlling variable is the surface area in the edge diffraction reduction. The rolled edge treatment takes a different approach. While extending the edge, the surface curvature changes gradually and the added skirt as a whole is rolled back. The latter treatment emphasizes the control of the curvature variable.

The surface area and curvature of the added skirt are two independent variables which can be varied simultaneously or individually. The edge diffraction reduction is an optimization process. The serrated edge treatment emphasizes the importance of the added skirt area, and the rolled edge treatment emphasizes the skirt curvature. These two treatments are both single-variable optimization procedures.

A microwave antenna projects a traveling microwave onto an aperture in free space. The electromagnetic field at each point as define by the projection becomes a new source of a secondary spherical wave and is known as Huygens' wavelet. The envelope of all Huygens' wavelets emanating from the antenna aperture at any instant of time is then used to describe the transmitting electromagnetic radiation from the antenna at a later instant of time. The above mechanism is known as the famed Huygens-Fresnel Principle. Mathematically, this principle can be represented by the Rayleigh-Sommerfeld diffraction formula which is a Fourier type integration.

The aperture of any antenna must be finite in size. This restriction imposes a rectangular window on the Rayleigh-Sommerfeld diffraction formula for an untreated microwave antenna. It is well known in Fourier analysis that a rectangular window leads to high side lobes. These side lobes can be properly reduced by employing smooth tapered windows before evaluating the Fourier transformation. The edge treatment of microwave antennas corresponds to imposing a smooth tapered window onto the Rayleigh-Sommerfeld diffraction formula. The serrated and rolled edge treatments differ in methods of tapering. The former is restricted to the magnitude tapering of the electromagnetic field at the aperture of a microwave antenna, and the latter is mainly confined to phase tapering with little controls on the magnitude. The electromagnetic field has two independent components—magnitude and phase. Any abrupt change in either component will lead to high sidelobes. Both serrated and rolled edge treatments are restricted to a single component, neglecting the other. The abrupt change can not be optimally removed with either of these two methods. The present invention treats both two components simultaneously, hence provide a better optimum method than either of them, therefore leading to much better side lobe reduction and a smaller size of the added skirt.

SUMMARY OF INVENTION

The edge treatment of the present invention is a dual-variable optimization procedure, and emphasizes the importance of the simultaneous variation of both serrated surface area and rolled curvature of the added skirt to the rim of conventional antennas. The serration controls the amplitude taper and the roll controls the phase taper of the transmitting or receiving radiation at the antenna. Amplitude and phase are two independent variables. The optimum variation of these two variables with respect to the specific requirements yields the serration shape and roll back rate of the invented microwave antenna edge. Many theoretical methods are available for accomplishing such a task. Several examples are given in the attached FIGS. 1, 2, 3, and 4 to illustrate the characteristic features of the invented edge treatment.

The skirt of the serrated-roll edge should be smooth and continuous. The minimum radius of curvature at any part of the skirt ought be at least in the order of the upper end radio wave length of antenna operation, to assure the smooth variation of the skirt surface. At the junction between the antenna surface and the serrated-roll skirt, the smoothness and continuity has to be properly maintained. It means the radius of curvature and a certain number of its derivatives are continuous across the junction. The skirt serration should also be smoothly variate, and may revert to a scalloped shape.

The above guide lines for the added skirt lead to many design variations. The serration can take different shapes and the roll back rate can be different. The serration shape and roll back rate are from optimized considerations of the operation frequency band, polarization, size, shape, gain, side lobe level, radome, mounting geometry, and other specific design requirements of the antenna. The reason is the same as the selection of Fourier windows for the reduction of the side lobes. Many types of windows can be chosen to fulfill the requirement of side reduction in Fourier transformation.

Theoretical calculations are needed to transfer the requirements to the design specifications of an optimum antenna with the invented serrated-roll edge. The base of calculations is the Rayleigh-Sommerfeld diffraction formula with the aide of the recently developed methods on the edge treatment of microwave antennas. The calculation will yield the design on the pattern of serration shape and roll back rate. A simple method to implement the design is first to construct a rolled skirt, than cut out the smooth serration shape.

The detailed design of a microwave antenna as suggested by the present invention depends on the shape, size, operating frequency, frequency bandwidth, feed, feed support, and mounting restriction of the antenna. The treatment of the present invention may be implemented through feeds, subreflectors, mounting surfaces, and antenna radomes as well as main reflector of microwave antennas. The edge serration with rolls can be different for these sub-components and is not necessarily required for every one of them. The key element of the present invention is the simultaneous optimization in tapering both amplitude and phase of electromagnetic waves at the antenna aperture. The present invention is total different from the hybrid treatment of microwave antennas, where a portion of the edge is rolled and the rest is serrated.

OBJECTS AND ADVANTAGES

The invention is a new design to enhance the performance of microwave antennas. The performance arises from the edge treatment of antennas, for the purposes of reducing sidelobe interference, and improving the quality of the reception and transmission of these antennas. Several objects and advantages of the present invention are:

1) to eliminate the ghosts created by objects surrounding the antenna;
2) to suppress the mutual interference among satellite-based, platform-based, and ground-based microwave systems;
3) to achieve optimum quiet zones in compact ranges;
4) to effectively beam microwave radiation;
5) to reduce the antenna size.

The invented microwave antenna edge will lead better antenna performance than either of the serrated edge and rolled edge respectively. The invented edge is also better than the edge covered by absorber material or coated by absorbing paints, since the weather can cause their deterioration. The invented antenna can be massively produced through molding and stamping to satisfy the commercial needs on high performance, small in size, and low in cost microwave antennas.

DRAWINGS

Figure 1A:
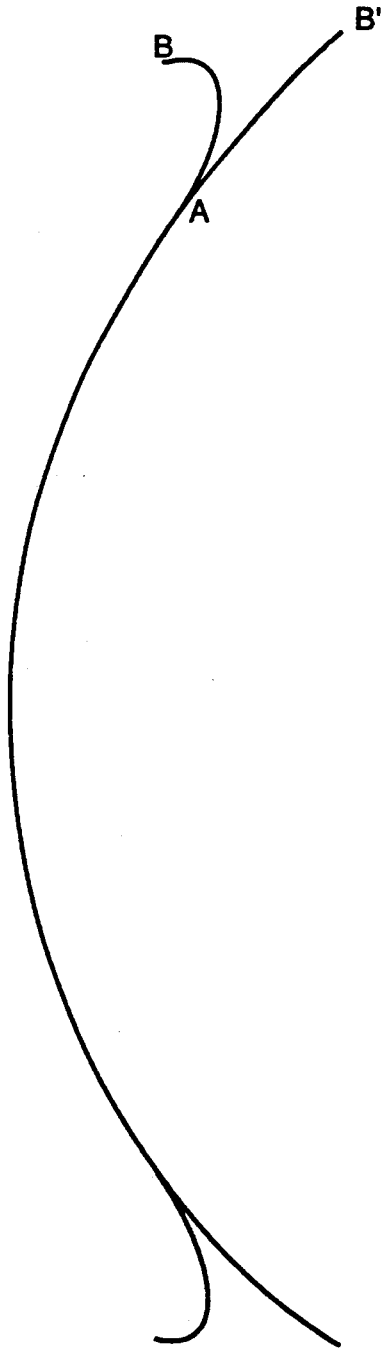

FIGS. 1 and 1*a*. An example of the invented microwave antenna with a serrated-roll edge.

Figure 2:
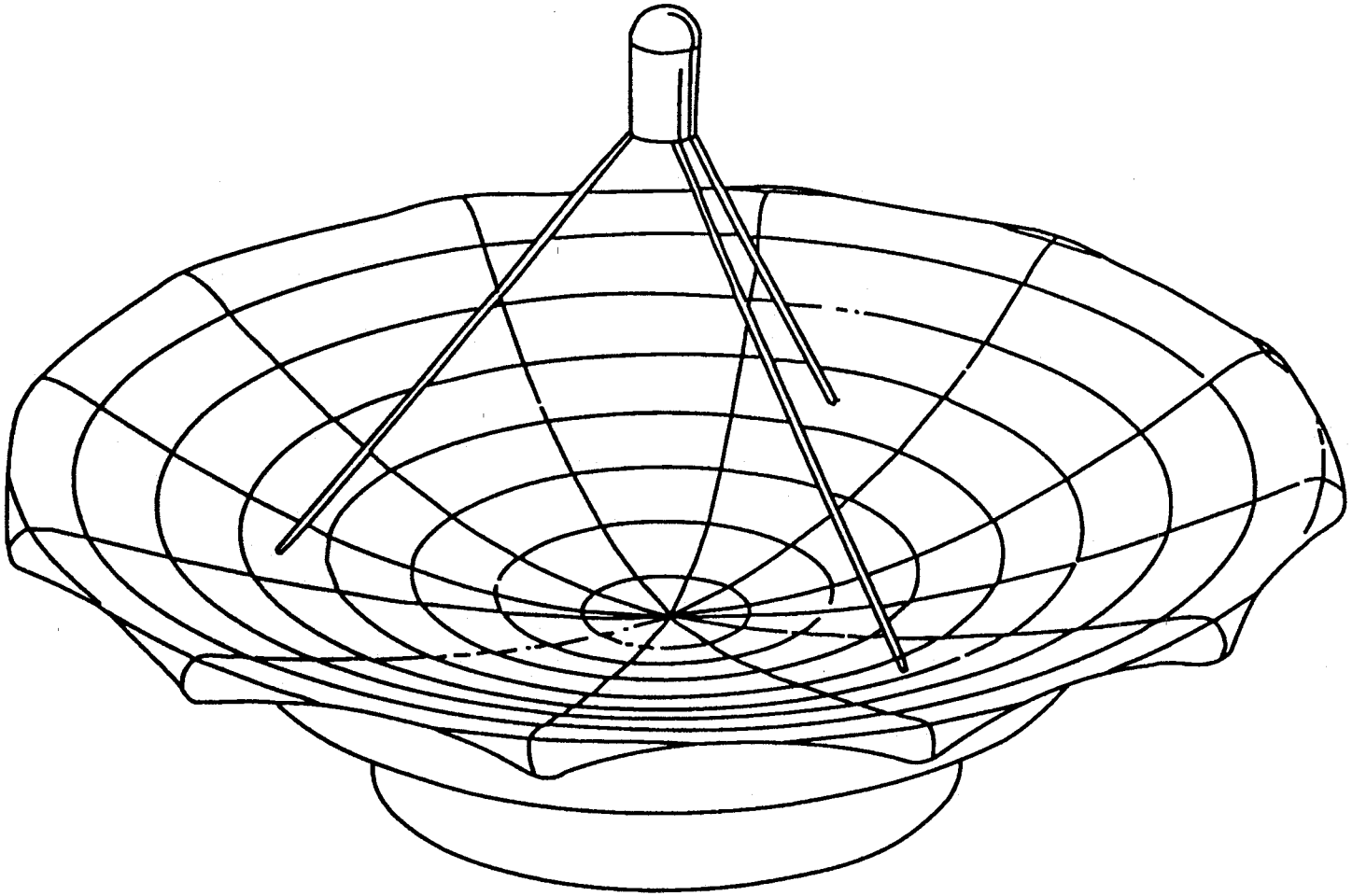

FIG. 2. Second example of the invented microwave antenna.

Figure 3:
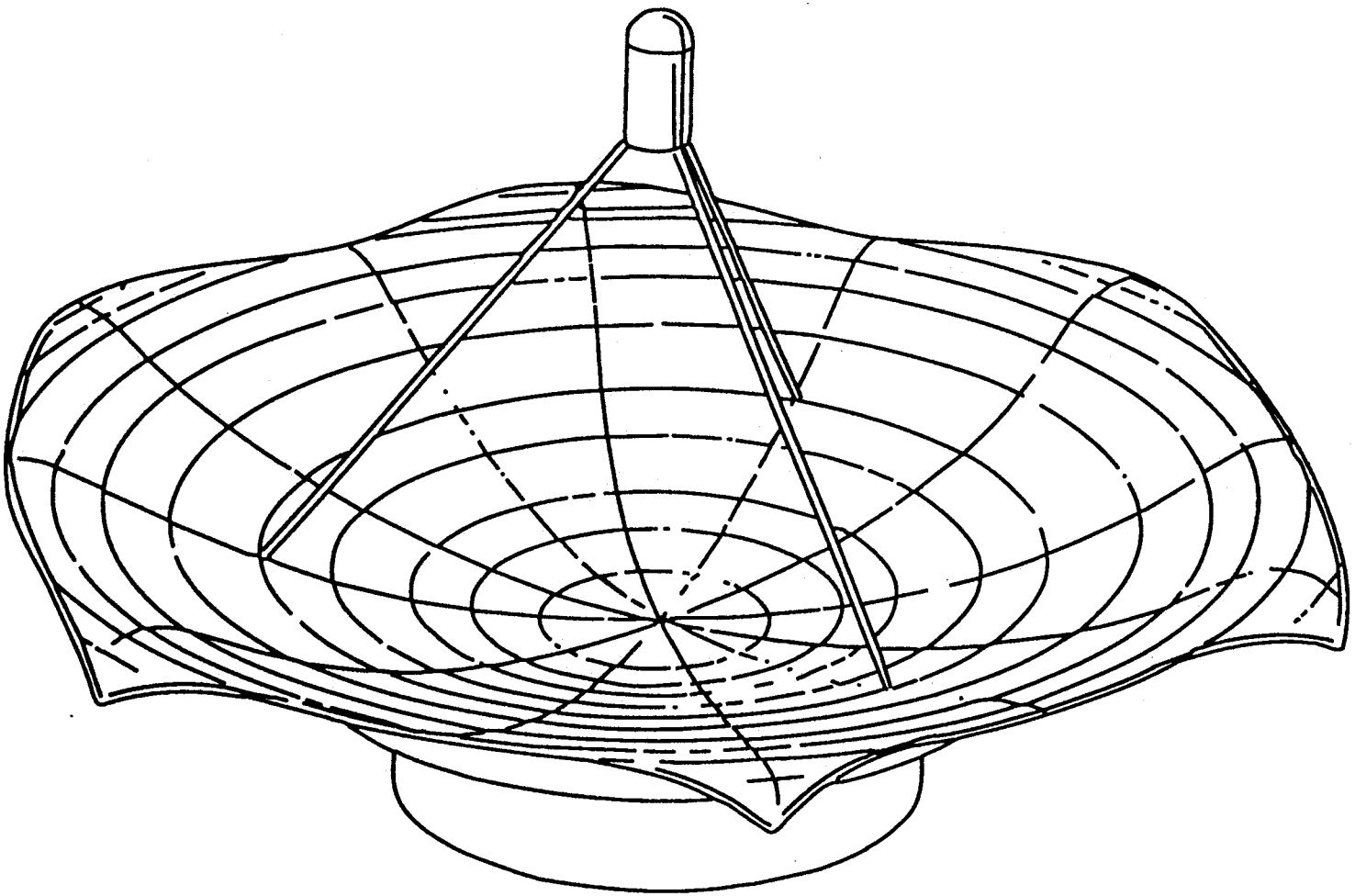

FIG. 3. Third example of the invented microwave antenna.

Figure 4:
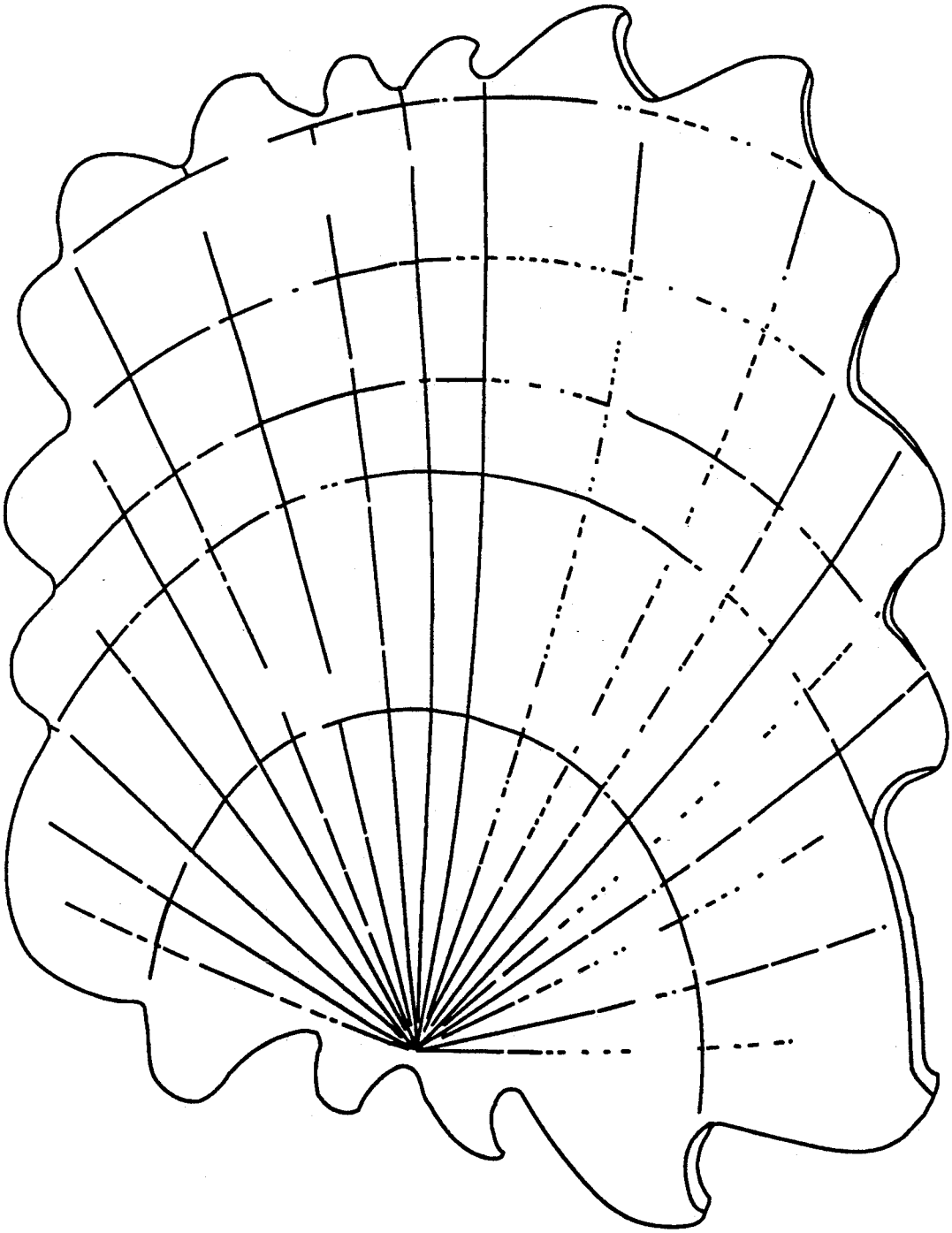

FIG. 4. A different example of the invented microwave antenna. The serrated-roll edge is irregular. The serration shape and roll back rate may vary.

FIG. 1 is an example of the invented antenna with a serrated-roll edge. If the skirt of the serrated-roll edge is removed, it is a normal center-fed microwave parabolic reflector. The center of the reflector and the feed are all on the axis of the paraboloid. The point A is at the rim of the untreated reflector. The requirements of smoothness and continuity indicate that the radii of curvature and a certain number of its derivatives from each respective side of the paraboloid and skirt should be continuous across this junction point A. AB' denotes the extension of the parabolic curve from the vertex of the reflector to point A. The curves AB and AB' have the same length. If the skirt is not rolled, than the point B should be at the point B' and the skirt is only serrated. The dotted line depicts the rim of a pure roll edge without serration.

The serrated-roll edge in FIG. 2 is different from the edge in FIG. 1 in both the shape and serration interval. FIGS. 2 and 3 are similar in serration shape, but differs in serration interval. FIGS. 1, 2, and 3 illustrate the design variations of the invented edges. FIG. 4 depicts a serrated-roll edge for an offset-fed microwave reflector. A center-fed reflector possesses the cylindrical symmetry, which does not exist for an offset-fed antenna. The lack of symmetry leads to the irregular shape of serration and the nonuniform rate of roll back. Offset-fed reflectors are widely used inside compact ranges. The implementation of invented edges for these reflectors are more complicated than the center-fed reflectors. The designs in FIGS. 1, 2, and 3 are inspired by the edge treatments of Chinese bells which are musical instruments as well as acoustical antennas. The considerations of reflections from the ground and surrounding environment can lead to nonsymmetric serrated-roll edge for center-fed reflectors. Spatial limitation, mounting mechanism, existence of surrounding objects, and other environmental conditions can also lead to invented edges with irregular serration shapes and mixed roll back rates. Multifunctional and virtual vertex antennas may have these variations as well.

SUMMARY, RAMIFICATIONS, AND SCOPE

The discussions and drawings given above contain many specifications, these should not be construed as limiting the scope of the invent but merely providing illustrations. Serrated edges with rolls can take many designs and shapes. The serration shape and roll back rate may vary even within an antenna. As added on improvement to existing antennas, skirts with the invented edge shape may attach to these antennas to enhance their performance. Microwave horn antennas have rectangular openings. The present invention can be implemented through a serrated extension of their horn surfaces then rolled back. A microwave antenna may be mounted under a surface, the present invention can be implemented through the mounting mechanism as well as on their radome designs.

Thus the scope of the invention should be determined by appended claims and their legal equivalent, rather than by the examples given.

I claim:

1. A microwave antenna comprises a body, the body comprises a bounded rim which defines an opening for radiating and receiving microwave radiations, wherein the body further comprises a skirt which is disposed at the rim, wherein the skirt comprises a serrated-roll edge, wherein the serrated-roll edge is a) smoothly and continuously rolled back; and b) shaped to form a serration, wherein an outer edge of the serration is gradually and smoothly curved.

2. The microwave antenna of claim 1 wherein said skirt provides an extended surface along the rim to the antenna body, wherein the surface is smooth and continuous and comprises a minimum radius of curvature at a part of the extended surface, wherein the minimum radius of curvature comprises a value which is at least as large as upper end radio wavelengths of antenna operation.

3. The microwave antenna of claim 1 wherein said body and skirt comprise their own respective radii of surface curvature on respective sides of the rim, wherein the radii of surface curvature comprise a predetermine number of derivatives; wherein the radii and derivatives of the radii are smooth and continuous across the rim.

4. The microwave antenna of claim 1 wherein said serrated-roll edge comprises a number of serrations; wherein each serration is smooth and rolled back.

5. A microwave antenna comprises a body, the body comprises a bounded rim which defines an opening for radiating and receiving microwave radiations, the body further comprises a skirt which is affixed to the rim, wherein the skirt comprises a serrated edge and the serrated edge is rolled back to form a serrated-roll edge, wherein an outer edge of the serration is gradually and smoothly curved.

* * * * *